US008950185B2

(12) United States Patent
Revenko

(10) Patent No.: US 8,950,185 B2
(45) Date of Patent: Feb. 10, 2015

(54) METHOD FOR CONVERTING ENERGY, INCREASING ENTHALPY AND RAISING THE COEFFICIENT OF COMPRESSIBILITY

(76) Inventor: Igor A. Revenko, Biysk (RU)

( * ) Notice: Subject to any disclaimer, the term of this patent is extended or adjusted under 35 U.S.C. 154(b) by 15 days.

(21) Appl. No.: 13/819,016

(22) PCT Filed: Apr. 4, 2011

(86) PCT No.: PCT/RU2011/000218
§ 371 (c)(1),
(2), (4) Date: Apr. 24, 2013

(87) PCT Pub. No.: WO2012/026845
PCT Pub. Date: Mar. 1, 2012

(65) Prior Publication Data

US 2013/0239574 A1 Sep. 19, 2013

(30) Foreign Application Priority Data

Aug. 26, 2010 (RU) ..... 2010135718

(51) Int. Cl.
*F01K 25/06* (2006.01)
*F01K 25/08* (2006.01)
*F01K 25/00* (2006.01)

(52) U.S. Cl.
CPC ..... *F01K 25/00* (2013.01); *F01K 25/06* (2013.01)
USPC ..... 60/649; 60/651; 60/671; 60/673

(58) Field of Classification Search
USPC ..... 60/649, 651, 671, 673
See application file for complete search history.

(56) References Cited

U.S. PATENT DOCUMENTS

| | | | | | |
|---|---|---|---|---|---|
| 4,196,594 | A * | 4/1980 | Abom | 60/649 |
| 4,422,297 | A * | 12/1983 | Rojey | 60/651 |
| 4,876,855 | A * | 10/1989 | Yogev et al. | 60/651 |
| 5,255,519 | A * | 10/1993 | Kakovitch | 60/649 |
| 5,444,981 | A * | 8/1995 | Kakovitch | 60/649 |
| 8,099,958 | B2 * | 1/2012 | Al-Mayahi et al. | 60/649 |

FOREIGN PATENT DOCUMENTS

| | | |
|---|---|---|
| RU | 245141 | 12/1971 |
| RU | 2114999 C1 | 10/1993 |
| RU | 2001119624 A | 3/2003 |
| RU | 2008145464 A | 5/2010 |
| RU | 2397334 C2 | 8/2010 |
| WO | WO 2007033958 A1 | 3/2007 |
| WO | WO 2009048479 A1 | 4/2009 |

* cited by examiner

*Primary Examiner* — Christopher Jetton
(74) *Attorney, Agent, or Firm* — Wolf, Greenfield & Sacks, P.C.

(57) ABSTRACT

The invention relates to a method for converting thermal energy into mechanical work, which comprises imparting thermal energy to a working fluid in a tank. The working fluid in the vapor phase is fed into a device for converting energy into mechanical work. The vaporous working fluid is condensed and cyclically returned in the liquid phase to the tank. A catalytic additive in the form of a catalytic substance or a catalytic mixture of substances in an amount of 0.0000001 to 0.1 wt. % is introduced into the working fluid before or after starting the heating. The additive is a solid, its solution or suspension, or a liquid or its emulsion. The catalytic substance and the ratio of components of the mixture are chosen to prevent or promote decomposition of the substance or the mixture under the effect of high temperature and pressure according to current needs. The method enhances the efficiency of the process and expands its operational capabilities.

5 Claims, 2 Drawing Sheets

Figure 1:
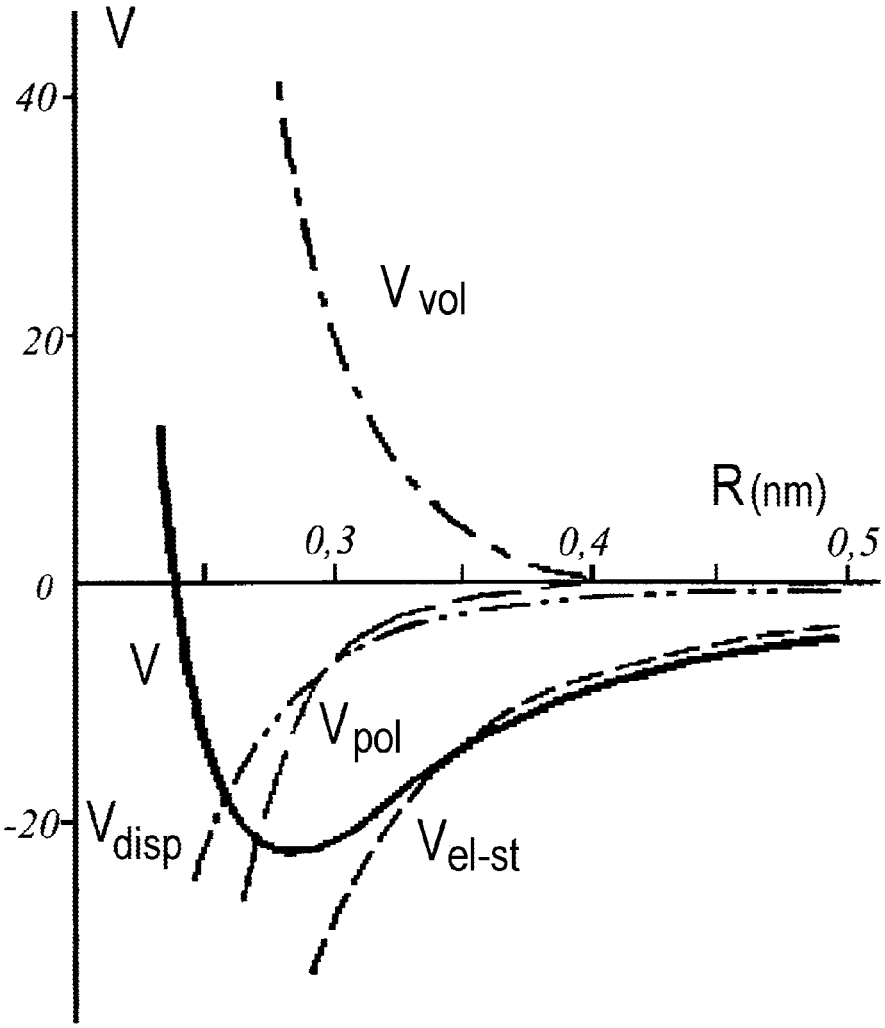

METHOD FOR CONVERTING ENERGY, INCREASING ENTHALPY AND RAISING THE COEFFICIENT OF COMPRESSIBILITY

The invention relates to the conversion of thermal energy into mechanical work with the use of a working fluid, in particular, for electric power generation, although it is not limited to this application.

Useful work can be done when one form of energy is converted into another: potential energy is to be converted into kinetic energy, thermal energy into mechanical energy, mechanical energy into electricity, and so on. Experimentally verified equivalence of all forms of energy leads to the first law of thermodynamics, that says that energy cannot be created or destroyed, and it is always conserved in one form or another. That is why efforts are being made to increase the efficiency of this process in order to maximize the production of a required form of energy, while minimizing the loss of energy in other forms.

Mechanical, electrical and kinetic energy are the forms of energy that that can be converted into one another with a very high degree of efficiency. However, this does not apply to thermal energy. If we try to convert thermal energy at temperature T into mechanical work, the efficiency of this process will be limited to $1-T_0/T$, where $T_0$ is the temperature of environment. The useful energy that can be transformed is called "exergy", while the energy that cannot be converted into exergy is called "anergy". Accordingly, the first law of thermodynamics can be formulated as "the sum of exergy and anergy is always constant."

Furthermore, the second law of thermodynamics, which says that processes are carried out in a given specified direction and cannot be carried in opposite direction, can be formulated as "anergy and exergy cannot be converted".

Thermodynamic processes can be classified into irreversible and reversible. In irreversible processes the performed work is equal to zero, and the exergy is converted to anergy. In reversible processes maximum possible work can be done.

Efforts of energy conversion are based on the second law with a view to use most of exergy before it will be converted into anergy, a form of energy that cannot be used anymore. In other words, conditions must be provided to support reversibility of the process as long as possible.

The present invention relates to the conversion of thermal energy into mechanical energy, in particular, for electric power generation, the most cumbersome process in terms of efficiency. In this process, heat is transferred to a working fluid, which is subjected in the reverse cycle to a number of relationships of temperature, pressure and volume. The Carnot cycle is well known as the ideal regenerative cycle, but a number of other conventional cycles, especially the Rankine cycle, as well as the cycles of Atkinson, Erikson, Brayton, Diesel and Lenoir, can used as well. In any of these cycles, a working fluid in the gaseous form is fed into a device for converting the energy of the working fluid into mechanical energy, such as a turbine, and a great many other types of heat engines. In each case, when the working fluid does useful mechanical work, the volume of the fluid increases, while its temperature and pressure decrease.

As the working fluid is important component of the cycle to do useful work, a number of processes are known in which the working fluid is modified in order to increase the useful work of the process. U.S. Pat. No. 4,439,988 describes the Rankine cycle, in which an ejector is used for injecting a working fluid in gaseous state into a turbine. It was found that through the use of an ejector for injecting light gas into a working fluid (after the working fluid has been heated and vaporized) the turbine recovers useful energy at a lower pressure drop than it would be required in the previous variant where only a working fluid is used. There is also a significant drop in the temperature of the working fluid, which ensures the operation of the turbine in an environment with a lower temperature. The following light gases can be used: hydrogen, helium, nitrogen, air, water vapor or organic compounds having a molecular weight less than that of the working fluid.

U.S. Pat. No. 4,196,594 describes a method involving injection of an inert gas, such as argon or helium, into a working fluid in gaseous phase (e.g. steam), used to perform mechanical work in a heat engine. Steam with additives has a lower adiabatic H-value, compared to the classical use of a working fluid with no additives, where H is defined as $C_p/C_v$, where $C_p$ is the specific heat at constant pressure, a $C_V$ is the specific value at constant volume.

U.S. Pat. No. 4,876,855 deals with a working fluid for a Rankine cycle power plant, the fluid including a polar and non-polar compound, with the polar compound having a molecular weight smaller than that of the non-polar compound.

These solutions use a gaseous additive as a substance modifying the working fluid, the use of which reduces the process safety and requires more complex equipment.

RU 2114999 (published on 7 Oct. 1998) also teaches a method for converting thermal energy into mechanical energy, which comprises introducing a catalytic additive into a working fluid; imparting to the working fluid in a tank a thermal energy sufficient to transfer the working fluid from liquid to vapor phase; feeding the working fluid in vapor phase in a device for converting energy into mechanical work with expansion of the vaporous working fluid and reduction in temperature and pressure; condensing vaporous working fluid, and cyclically returning the working fluid in liquid phase into the tank.

Disadvantages of this method include the need for measures to ensure safety of the process when hydrogen or helium is added to the working fluid, safe transportation and storage of the gaseous additive in cylinders under pressure, obligatory stage for recovery of the additive from expanded and cooled working fluid, which complicates the process and its equipment, and the need to introduce the additive in large amounts, which reduces the economic attractiveness of the method. Furthermore, the method has limitations on the choice of substances suitable for its implementation, i.e. substances with a molecular weight of no more than the molecular weight of the working fluid, and the choice of the sequence of operations: the catalytic additive is introduced into the working fluid that has been already filled in the tank, and only after transferring the working fluid into vapor, and not earlier, which reduces its operational capabilities.

Furthermore, RU 2114999 discloses a method for increasing the enthalpy and compressibility factor of steam, which comprises heating water in a tank to produce steam; introducing a catalytic additive in form of a catalytic substance or a catalytic mixture of substances into water.

The method is uneconomical and requires the introduction of up to 9 wt. % helium in particular applications, special measures to ensure safety during transportation, storage and use, and complex equipment. In addition, the method has severe limitations on the choice of materials suitable for its implementation: only hydrogen and/or helium, and an indispensable condition of feeding the catalytic additive precisely into vapor, which reduces its operational capabilities.

Application RU 2008145464 (published 27 Jun. 2010) discloses a process for converting thermal energy into mechanical, which has been developed by the inventor of the present invention and is the most relevant prior art in respect of one invention in the group, comprising: introducing a catalytic additive into a working fluid; imparting thermal energy sufficient to transfer the working fluid from liquid to vapor phase to the working fluid in a tank; feeding the working fluid in vapor phase into a device for converting energy into mechanical work with expansion of the vaporous working fluid and reduction in temperature and pressure; condensing the vaporous working fluid; cyclically returning the working fluid in the liquid phase to the tank, wherein the catalytic additive is introduced into the working fluid before or after imparting thermal energy to it; the catalytic additive is a substance that contains at least one carbonyl functional group and has at least one absorption band in the region from 1550 to 1850 $cm^{-1}$ in the IR spectrum.

Disadvantages of the prior art method include limitations on the choice of steam generators used, in particular, only high pressure steam generators with natural circulation of fluid. Application of the method at once-through steam generators may be difficult due to the transport of active substances into the device for converting thermal energy into mechanical work, as well as the vaporous working fluid into a condenser, which will neutralize the advantages of the process. The method is difficult to implement at ultra- and supercritical steam generators due to the rapid decomposition of active substances under the effect of high pressures and temperatures.

The disadvantages are caused by the fact that the method provides for the use of only an individual catalytic substance in each particular case, and does not involve the possibility of optimizing the target process in practice in accordance with current needs and process conditions.

RU 2008145464 discloses a method for increasing the enthalpy and compressibility factor of steam, the most relevant art for the second invention in the present group, which comprises heating water in a tank to produce steam; introducing a catalytic additive into water, wherein the catalytic additive is introduced into water before or after heating it, the catalytic additive is a substance containing at least one carbonyl functional group and has at least one absorption band in the region from 1550 to 1850 $cm^{-1}$ in the IR spectrum.

The method has significant limitations on the application in once-through steam generators and ultra- and supercritical steam generators due to the very stringent requirements on the quality of feed water, as well as the quality of superheated steam supplied to the steam turbine. The disadvantages are caused by the fact that the prior art method involves the use of only an individual catalytic substance in each particular case and does not provide for the possibility of optimizing the target process in practice in accordance with current needs and working conditions.

The present group of inventions includes a method for converting thermal energy into mechanical energy and a method for increasing the enthalpy and compressibility factor of steam, which has the same object—to increase the efficiency of the target process by enhancing the enthalpy of steam and increasing the expansion of the working fluid through the implementation of conditions ensuring the increase in the specific heat of vaporization, while expanding the operating capacities and facilities in accordance with current needs and process conditions owing to the revealed opportunity to use both an individual catalytic substance and a catalytic mixture of substances suitable to be used as the catalytic additive, as well as minimizing the amount of introduced additive, which provides for the economic attractiveness of the methods.

It should be noted that the inventor has found a previously unknown effect of the introduction of a catalytic additive on increasing the liquid-to-vapor phase transition rate, both with an individual catalytic substance and a catalytic mixture of substances chosen for implementing the present invention.

The applicant believes that the catalytic substance and catalytic mixtures of substances used according to the present invention promote crystallization of hardness salts within the bulk of the working fluid, rather than on heat transfer surfaces, the salts become evaporation cites, which ultimately increases the speed of phase transfer of the working fluid.

In addition, implementing the possibility to transfer by a smaller amount of vaporized working fluid more energy through the introduction of an additive allows the target process to be carried out at an acceptable high process rate with maximum possible reduction of the evaporation stage.

The object is accomplished in a method of converting thermal energy into mechanical energy, comprising introducing a catalytic additive into a working fluid; imparting thermal energy sufficient to transfer the working fluid from liquid to vapor phase to the working fluid in a tank; feeding the working fluid in the vapor phase into a device for converting energy into mechanical work with expansion of the vaporous working fluid and reduction in temperature and pressure; condensing the vaporous working fluid; cyclically returning the working fluid in the liquid phase into the tank, wherein said introducing of a catalytic additive into a working fluid is accomplished before or after said imparting of thermal energy thereto; a catalytic substance or a catalytic mixture of substances is used as the catalytic additive in the form of a solid, a solution or suspension thereof or a liquid or emulsion thereof; said catalytic substance or at least one substance in the catalytic mixture comprises at least one carbonyl functional group and has at least one intense absorption band in the region from 1550 to 1850 $cm^{-1}$ in the IR spectrum; the additive is introduced in an amount ranging from 0.0000001 to 0.1 wt. %, and the catalytic substance and the weight ratio of individual substances in the catalytic mixture are chosen to prevent or promote decomposition of the substance or the mixture under the effect of high pressure and temperature in accordance with current needs.

In particular, the working fluid is water, or liquid hydrocarbon, or a mixture of liquid hydrocarbons.

In particular, the substance or substances for the additive is selected from the group including: monocarboxylic acids and anhydrides thereof; dicarboxylic acids and anhydrides thereof; salts of carboxylic acids; salts of dicarboxylic acids; amides of carboxylic acids; amides of dicarboxylic acids; anilides of carboxylic acids; anilides of dicarboxylic acids; esters of carboxylic acids; monoesters and diesters of dicarboxylic acids; imides of carboxylic acids; imides of dicarboxylic acids; diamide of carbonic acid; acyclic and cyclic esters of carbonic acid; urethanes; amino carboxylic acids, the molecules of which contain amino groups ($NH_2$ groups) and carboxyl groups (COOH groups); peptides and proteins, the molecules of which are made of remains of α-amino acids connected by peptide (amide) bonds C(0)NH.

The object of the invention is accomplished in a method for increasing the enthalpy and compressibility factor of steam, comprising heating water in a tank to produce steam; introducing a catalytic additive into the water, said introducing of a catalytic additive into the water being accomplished before or after starting said heating; using a catalytic substance or a catalytic mixture of substances as the catalytic additive in the form of a solid, a solution or suspension thereof or a liquid or emulsion thereof, wherein said catalytic substance or at least one substance in the catalytic mixture comprises at least one carbonyl functional group and has at least one intense absorption band in the region from 1550 to 1850 $cm^{-1}$ in the IR spectrum; the additive is introduced in an amount ranging from 0.0000001 to 0.1 wt. %, and the catalytic substance and the weight ratio of individual substances in the catalytic mixture are chosen to prevent or promote decomposition of the substance or the mixture under the effect of high pressure and temperature in accordance with current needs.

In particular, the substance or substances for the additive is selected from the group including: monocarboxylic acids and anhydrides thereof; dicarboxylic acids and anhydrides thereof; salts of carboxylic acids; salts of dicarboxylic acids; amides of carboxylic acids; amides of dicarboxylic acids; anilides of carboxylic acids; anilides of dicarboxylic acids; esters of carboxylic acids; monoesters and diesters of dicarboxylic acids; imides of carboxylic acids; imides of dicarboxylic acids; diamide of carbonic acid; acyclic and cyclic esters of carbonic acid; urethanes; amino carboxylic acids, the molecules of which contain amino groups ($NH_2$ groups) and carboxyl groups (COOH groups); peptides and proteins, the molecules of which are made of remains of α-amino acids connected by peptide (amide) bonds C(0)NH.

Comparative analysis has shown that the present methods differ from the most relevant prior art by a different amount of the catalytic additive, the possibility to use not only an individually taken catalytic substance, but also a catalytic mixture of substances, thereby extending the range of applicability of these methods in all types of steam generators. Implementation of the present methods increases the enthalpy and compressibility factor of the working fluid in the vapor phase in steam generators both with natural circulation and with multiple forced circulations, as well as in once-through steam generators.

The introduced individual catalytic substances or a catalytic mixture of substances increase the specific heat of vaporization and specific heat capacity of the working fluid, thereby increasing the enthalpy of steam, and decreasing the amount of the vapor generated per time unit. This increases the thermal efficiency of the steam turbine heat cycle. The aforementioned catalytic substances or catalytic mixtures of substances have an effect only on the working fluid in the steam generator when they are added to it. When a steam generator with natural circulation of fluid is used, the transfer of the catalytic substance or catalytic mixture of substances into the condenser of heat power plant doesn't occur due to separation and washing the steam with the working fluid in the steam generator drum. When a steam generator with forced circulation of the working fluid (once-through steam generator) is used, the transfer of the catalytic substance or the catalytic mixture of substances into the condenser of heat power plant doesn't occur due to decomposition of the catalytic substance or catalytic mixture of substances by superheated steam. As a result, condensation of the vaporous working fluid proceeds in normal conditions (unaffected by the catalyst). Accordingly, the same amount of the working fluid is formed and condensed per time unit, but evaporation takes place in modified conditions affected by the introduced catalysts, while condensation proceeds in normal conditions. In this way, a smaller amount of vaporized working fluid can transfer more energy, which leads to increasing the thermal efficiency of the heat cycle of the steam turbine plant.

Enthalpy is an extremely important thermodynamic property in analysis of the thermal-to-mechanical energy conversion. Enthalpy is defined as the sum of internal energy and the pressure-volume product, H=U+PV. Enthalpy per unit mass is defined as the sum of internal energy and the pressure-specific volume product, h=U+Pu. As pressure approaches zero, all gases approach the ideal gas, and change in the internal energy is defined as the product of specific heat capacity $C_p$ and temperature increment dT. Increment of "ideal" enthalpy is defined as the of the product of $C_p$ and temperature increment: $dh=C_p dT$. Until the pressure is greater than zero, the enthalpy increment is an "actual" enthalpy. The ratio of the difference between the ideal enthalpy and actual enthalpy to the critical temperature of the working fluid is referred to as "residual enthalpy".

The inventor has theoretically substantiated that a greater efficiency of the reversible process can be achieved, if the actual increment of enthalpy is succeeded in the range of temperatures and pressures required for its previous state. This presumably could be implemented by the methods allowing release of "residual" enthalpy, substantially, by reducing exergy losses in the system.

Another very important feature of the working fluid is the compressibility factor Z, used to determine the conformity of the behavior of a real gas with that of the ideal gas. The ideal gas behavior under variable pressure (P), volume (V) and temperature (T) is determined by the state equation:

$$pV = \frac{m}{\mu}RT,$$

where p—the pressure of gas;

V—the volume occupied by gas;

T—the thermodynamic temperature of gas;

m—the mass of gas;

μ—the molar mass of gas;

R—the absolute gas constant.

Denote specific gas constant as R=Rμ/μ, than the equation for one kilogram of gas can be written as:

$$\rho\upsilon = RT,$$

where

υ=V/m—the specific volume of gas.

Actually, this equation does not fully describe the real gas behavior, for which the following relation has been determined:

$$\rho\upsilon = ZRT,$$

where

Z—the compressibility factor.

For an ideal gas Z is equal to 1, while for real gas the compressibility factor varies with temperature and pressure. Although the compressibility factors for different gases are different, it has turned out that actually they are constant, if they are determined as functions of the same reduced pressure value. Reduced temperature is defined as the ratio between temperature and critical temperature $T/T_c$, and reduced pressure is defined as the ratio between pressure and critical pressure $P/P_c$. Critical temperature and pressure are the temperature and pressure at which the meniscus between the liquid and gas phases of a substance disappears, and the substance forms a single, continuous liquid phase.

The inventor has theoretically substantiated that a significant expansion of volume can be attained by changing the compressibility factor of vaporous working fluid.

The inventor has also theoretically substantiated that a substance or a mixture of substances can be found, which would increase the enthalpy and compressibility factor of vaporous working fluid.

Furthermore, the inventor has theoretically substantiated that a substance or a mixture of substances can be found, which would increase the specific heat of vaporization and the specific heat capacity of working fluid, thereby increasing the enthalpy of the vaporous working fluid.

Thus, the object of the invention is to increase the enthalpy and decrease the formation of vaporous working fluid per time unit at a constant supply of thermal energy to the working fluid in order to enhance the efficiency of conversion of energy into electric power.

Another object of the invention is to increase expansion of vaporous working fluid in order to increase the work made by the vaporous working fluid.

Efficiency of this process can be enhanced by adding a substance or a mixture of substances, which contribute to increasing the specific heat of vaporization and the specific heat capacity, to the working fluid.

The practical effect of the addition of a substance or a mixture of substances, which contribute to increasing the specific heat of vaporization and the specific heat capacity, is manifested in a significant increase in the enthalpy increment, thus in expansion, to which the vaporous working fluid is subjected at given temperature and pressure. With this greater expansion more mechanical work can be done at a fixed amount of supplied thermal energy, or the thermal energy amount can be reduced in order to obtain given amount of work. In any case, there is a significant increase in the efficiency of the process.

When developing the present invention, the inventor theoretically substantiated that with heating a working fluid in a tank the enthalpy of the vaporous working fluid within a specified temperature range is greater when a "catalytic" substance is added to the working fluid. In those cases where the working fluid comprises a "catalytic" substance, the specific heat of vaporization of the working fluid is higher, and the mass of vaporous working fluid formed per time unit is less compared to the same system, but without the catalyst.

The term "catalytic" is used by the inventor because the substances introduced to attain the technical effect exhibit properties of "spin catalyst", i.e. induce transitions between triplet and singlet states in electrons in the outermost electron shells of water molecules. The terms "spin catalysis" and "spin catalyst" are used in spin chemistry, the science which deals with the laws governing the behavior of spins and magnetic moments of electrons and nuclei.

The inventor believes that, by affecting the intermolecular interactions, in particular, the exchange interaction between molecules of the working fluid, by a "catalytic" substance, the enthalpy of steam generated in the process can be substantially modified.

Intermolecular interactions are interactions of molecules with each other, which do not lead to breakdown or formation of new chemical bonds. Intermolecular interactions determine the difference of real gases from ideal ones. Many structural, spectroscopic, thermodynamic, thermophysical and other properties of substances depend on intermolecular interactions. Intermolecular interactions are based on the Coulomb interaction forces between electrons and nuclei of one molecule and nuclei and electrons of the other. In experimentally determined properties of a substance the average interaction is manifested, which depends on distance R between the molecules, their relative orientation, structure and physical properties (dipole moment, polarizability, etc.). For large R, much larger than linear size L of the molecules, so that the electron shells of the molecules do not overlap, forces of the intermolecular interactions can be reasonably divided into three types: electrostatic ($V_{el\text{-}st}$), polarization (induction) ($V_{pol}$) and dispersion ($V_{disp}$). At small distances between the molecules (R~L) certain types of intermolecular interactions can be distinguished only approximately; in this case, in addition to these three types, two more types can be distinguished, which are related to the overlap of electron shells: exchange interaction ($V_{exh}$) and interaction due to electronic charge transfer. Despite some conventionality, such a division in each particular case allows explaining the nature of intermolecular interactions and calculation of its energy.

The total energy of intermolecular interactions, or intermolecular potential (V), is approximately equal to the sum of the contributions of individual types of intermolecular interactions:

$$V=V_{el\text{-}st}+V_{pol}+V_{disp}+V_{exh}.$$

Calculations show that in those cases, when the molecules are polar, the largest absolute contribution to the energy of attraction at R~$R_e$ gives $V_{el\text{-}st}$. Value of $V_{exh}$ is of the same order, but it leads to the repulsion of the molecules. In this case, contributions of $V_{pol}$ and $V_{disp}$ are, generally, from 20 to 40% of the total energy of attraction. FIG. 1 shows a typical dependence of the total energy of interaction of polar molecules and its individual contributions on R for water dimer.

Exchange interaction is the specific quantum mechanical interaction of identical particles, in particular electrons. Exchange interaction is manifested only at direct approach of atoms. In systems with closed shells the exchange interaction energy is positive, and the exchange interaction leads to repulsion of particles. Just such a situation occurs in the interaction of inert atoms or neutral molecules. If at approach of atoms or molecules the electrons in the outermost electron shells are in the singlet state (↑↓—spin projections on the quantization axis), i.e. the total spin is equal to zero (S=0), atoms or molecules are attracted, and while in the triplet state (↑↑, ↓↓, →→) i.e. the total spin is equal to one (S=1), atoms or molecules are repelled. This shows that statistically the approaches in the triplet and singlet states are related as ¾ to ¼, which leads to predominant repulsion of molecules. If a "spin catalyst" is used, which will facilitate the conversion of a pair of electrons in the outermost electron shells of the approaching atoms or molecules from the triplet spin state into the singlet one, the ratio can be changed towards increasing the approaches in the singlet state. The effect of the "spin catalyst" is not associated with a decrease in the interaction activation energy. Magnetic interactions of approaching atoms or molecules with a "spin catalyst" make a negligible contribution to the energy of interaction, but they change the spin state of the electrons in the outermost electron shells, remove the spin prohibition on the attraction of molecules. Thus, the "spin catalyst" controls the interaction through inducing in the electrons in the outermost electron shells of the approaching atoms or molecules transitions between singlet and triplet states, which are characterized by different energy capacity. Increasing the probability of approaches in the singlet state can reduce $V_{exh}$ value and thus increase the attraction of molecules. Hence, the total energy of intermolecular interactions, or intermolecular potential (V), will be reduced. This will lead to an increase in specific heat capacity and specific heat of vaporization of the working fluid.

Specific heat capacity at constant volume $C_V$ is the amount of heat received or given up by a working fluid with mass of 1 kg at the variation in its temperature by 1 K. It can be written as:

$$\delta Q=mC_v dT,$$

where

δQ—the amount of heat;

$C_V$—the specific heat capacity of the working fluid;

m—the mass of the working fluid;

dT—the variation in temperature of the fluid.

If the working fluid absorbs a certain amount of heat δQ and does no work, its temperature increases, because the absorbed heat is used for increasing both the average potential energy of interaction and the average kinetic energy of molecules of the substance. If the intermolecular potential (V) is reduced, i.e. the mutual attraction of the molecules is increased, the expenditure of energy for increasing both the average potential energy of interaction, and the average kinetic energy of molecules of the working fluid will increase. Therefore, the specific heat capacity of the working fluid will increase.

Specific heat of vaporization r is the amount of heat required to convert 1 kg of liquid into vapor at the same temperature. The total amount of heat, which should be expended to convert liquid with mass m into vapor, is:

$$Q_{vapor}=rm.$$

To convert liquid into vapor a certain amount of heat is to be spent for breaking the intermolecular bonds. Temperature of the vaporized liquid does not change, until the liquid is entirely transformed into vapor. This is because all of the supplied heat is spent on increasing the potential energy of the molecules, which are fairly close to each other in the liquid and must move away at considerable distances at the liquid-to-vapor conversion after breaking the intermolecular bonds. If the intermolecular potential (V) is reduced, i.e. the mutual attraction of the molecules is increased, the energy spent to break the intermolecular bonds will increase. Therefore, the specific heat of vaporization will increase.

Figure 2:
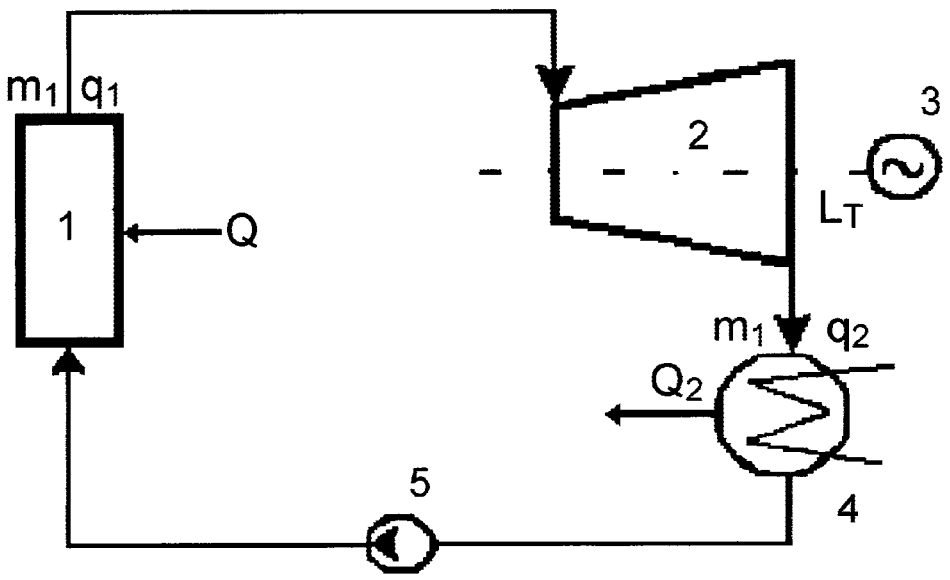

Steam power plants use the Rankine cycle with complete condensation of the turbine exhaust steam. FIG. 2 shows a cycle diagram of a heat and power plant which implements this cycle.

A device shown in FIG. 2 uses a boiler 1 to heat a working fluid, where in the process of heat supply (specific amount of heat input Q, kJ/s) the fluid is brought to the boiling point, evaporated and superheated in a superheater to generate steam (specific amount $m_1$, kg/s, with enthalpy $q_1$, kJ/kg). Exit of the boiler 1 is connected to a steam turbine 2, in which in the process of converting thermal energy of superheated steam into mechanical energy of the turbine's rotary shaft the steam is expanded, and turbine's power $L_T$ (kJ/s) is transferred to the shaft of an electric generator 3. The working fluid which has been subjected to expansion in the turbine 2 is sent to a condenser 4 of the turbine plant, where turbine exhaust steam (specific amount $m_1$, kg/s, with enthalpy $q_2$, kJ/kg) at constant pressure $p_k$ condenses and gives up heat (specific amount of heat output $Q_2$, kJ/s) to cooling water. After the condenser 4 the working fluid is subjected to adiabatic compression by a feed pump 5 and returned to the boiler 1.

In the following equations superscript "0" refers to properties of pure steam, and superscript "k" refers to properties of steam produced with introduction of a catalytic substance (for a specific amount, enthalpy and work).

Let a constant amount of thermal energy equal to Q=80, 000 kJ/s is input to the boiler per time unit.

The specific amount of produced pure steam is $m_1^o$=100 kg/s with enthalpy $q_1^o$=800 kJ/kg, and the specific amount of steam generated with the introduction of the catalytic substance, which increases the intermolecular bonds, is $m_1^k$=80 kg/s with enthalpy $q_1^k$=1000 kJ/kg. It will be seen that $Q=m_1^0q_1^0=m_1^kq_1^k$=80,000 kJ/s.

In the turbine plant condenser at constant pressure $p_k$ the turbine exhaust steam, having enthalpy $q_2$=500 kJ/kg, condenses and gives up heat $Q_2$ to cooling water. At condensation of pure steam, $Q_2=m_1^0q_2$=50,000 kJ/s, while at condensation of steam generated with the introduction of the catalytic additive, $Q_2^k=m_1^kq_2$=40,000 kJ/s. As already told above, no transport of additive substances into the condenser of the heat and power plant will occur, therefore the condensation of steam occurs under standard conditions in both cases.

Turbine power $L_T$ is equal to $L_T^0=Q-Q_2^0$=30,000 kJ/s when the steam turbine plant operates on pure steam, and $L_T^k=Q-Q_2^k$=40,000 kJ/s LT when it operates on the steam formed with introduction of the catalytic additive.

Absolute or thermal efficiency of the steam turbine plant under consideration is expressed through the ratio of useful theoretical work of steam in loop $L_T$ to heat Q transmitted to the working fluid in the boiler, as follows: $\eta_t=L_T/Q$. When the steam turbine plant operates on pure steam, $\eta_t=L_T^0/Q$=0.375 or 37.5%, while in the case of operation on steam formed with the introduction of the catalytic additive, $\eta_t=L_T^K/Q$=0.5 or 50%.

Thus, the above equations demonstrate that under given conditions the thermal efficiency of the steam turbine plant under consideration is higher after introduction of the catalytic additive into the working fluid, than in the case where pure steam is used. By increasing the enthalpy and compressibility factor of steam under these conditions, the amount of work done can be significantly increased.

The theory has been applied to calculate the enthalpy released from steam, but it is equally applicable to any and every working fluid, which is heated to gaseous state and which is subject to expansion and cooling to do mechanical work.

Therefore, the introduction into a working fluid of a catalytic substance or a catalytic mixture of substances that contribute to the increase in the specific heat capacity and specific heat of vaporization of the fluid increases the amount of work done at the same heat input. Table below shows experimentally obtained data, demonstrating an increase of the specific heat of vaporization of water depending on the use of an additive of a particular catalytic substance or a catalytic mixture of substances (at 100° C.)

TABLE

| Class of substances | Substances | Concentration in water, g/cu m | Increase in heat of vaporization, % |
|---|---|---|---|
| Salts of carboxylic acids | sodium acetate | 5.5-7.0 | 0.2-0.3 |
| | ammonium acetate | 8.0-10.0 | 0.2-0.3 |
| Salts of dicarboxylic acids | ammonium oxalate | 4.5-5.5 | 0.3-0.35 |
| | potassium oxalate | 6.5-7.0 | 0.4-0.5 |
| Amides of carboxylic acids | acetamide | 9.0-12.0 | 0.5-0.6 |
| | benzamide | 10.0-12.5 | 0.5-0.6 |
| Amides of dicarboxylic acids | oxamide | 5.0-6.0 | 0.3-0.4 |
| | succinamide | 3.0-4.0 | 0.5-0.6 |
| Anilides of carboxylic acids | acetanilide | 8.0-11.5 | 0.6-0.7 |
| | formanilide | 9.0-12.5 | 0.6-0.7 |
| Anilides of dicarboxylic acids | oxanilide | 3.5-4.5 | 0.55-0.65 |
| | succinanilide | 5.0-6.0 | 0.6-0.7 |
| Esters of carboxylic acids | ethyl acetate | 0.5-1.0 | 0.4-0.5 |
| | butyl butyrate | 0.7-1.2 | 0.4-0.5 |
| Monoesters and diesters of dicarboxylic acids | Octyl phthalate | 0.3-0.4 | 0.5-0.6 |
| | dibutyl phthalate | 0.5-0.6 | 0.6-0.7 |
| Imides of carboxylic acids | acetic acid imide | 0.8-1.0 | 0.6-0.7 |
| | propionic acid imide | 0.85-1.0 | 0.6-0.7 |
| Imides of dicarboxylic acids | Adipic acid imide | 0.7-0.8 | 0.6-0.7 |
| | succinimide | 0.75-0.9 | 0.6-0.7 |
| Complete amide of carbonic acid | carbonic acid diamide (carbamide) | 1.0-3.5 | 0.2-0.3 |

TABLE-continued

| Class of substances | Substances | Concentration in water, g/cu m | Increase in heat of vaporization, % |
|---|---|---|---|
| Acyclic and cyclic esters of carbonic acid (organic carbonates) | dibutyl carbonate | 0.08-0.12 | 1.0-1.5 |
| | propylene carbonate | 0.07-0.12 | 1.0-1.5 |
| Urethanes | ethyl carbamate | 1.0-2.0 | 0.9-1.1 |
| | propyl carbamate | 0.1-0.3 | 0.9-1.1 |
| Amino-carboxylic acids | glycine | 2.5-3.5 | 0.7-0.8 |
| | lysine | 0.8-1.5 | 0.7-0.8 |
| Peptides and proteins | carnosine | 4.0-5.0 | 1.0-1.2 |
| | protamine | 2.5-3.5 | 1.0-1.2 |
| Mixtures of substances | carbamide | 0.1-0.2 | 0.7-0.8 |
| | acetic acid | 0.1-0.2 | |
| | ethyl acetate | 0.2-0.3 | |
| | carbamide | 0.2-0.3 | 0.8-0.9 |
| | oxalic acid | 0.25-0.35 | |
| | benzamide | 0.3-0.4 | |
| | succinimide | 0.25-0.35 | 0.8-0.9 |
| | succinic anhydride | 0.2-0.3 | |
| | formanilide | 0.35-0.4 | |
| | ethyl acetate | 0.2-0.3 | 0.7-0.8 |
| | oxanilide | 0.2-0.3 | |
| | ammonium acetate | 0.25-0.35 | |
| | octyl phthalate | 0.5-0.55 | 0.7-0.8 |
| | glycine | 0.6-0.65 | |
| | potassium oxalate | 0.3-0.4 | |
| | succinanilide | 0.2-0.3 | 1.0-1.1 |
| | carbamide | 0.1-0.2 | |
| | carnosine | 0.15-0.25 | |

In practice, tests of boilers with natural circulation were carried out on E-500-13,8-560 GMVN boiler (TGME-428/A model), designed to produce superheated, high-pressure steam with steam parameters P=13.8 MPa, t=560° C. The steam boiler features a swirling-type furnace, natural circulation, a single drum, and a multi-pass arrangement of heat surfaces. The boiler is gastight under supercharging or with balanced draft. The boiler is designed to burn natural gas. The boiler is equipped with sensors to provide control on all operation parameters of the boiler. Valves were also mounted in the boiler to introduce a catalytic additive into the working fluid in the boiler.

Steam produced in the boiler was fed to T100/120-130-3 steam turbine plant manufactured by Ural Turbomechanical Plant, having rated power of 100,000 kW at n=3000 rev/min, designed to work with steam condensation and one, two and three-stage heating of water in a mains-operated heater and in a dedicated condenser bundle. Estimated parameters of fresh steam: $P_0$=12.75 MPa (130 kg/sq cm), $t_o$=565° C., the nominal cooling water flow 4.45 cu m/s (16,000 cu m/h). The turbine comprises three cylinders with 25 stages.

Effect of the catalytic additive introduced into the working fluid was observed on the variation in the flow rate of natural gas under a constant boiler load (given amount of steam at nominal pressure). In one of the tests acetanilide with concentration of 12 g/cu m was used, while in the other test a mixture was used (ethyl carbamate at concentration of 2 g/cu m, carbamide at concentration of 1 g/cu m, acetanilide at concentration of 2 g/cu m).

Individual catalytic substance and the ratio of substances in the catalyst mixture were chosen to prevent decomposition of the substance or the mixture under the effect of high temperature and pressure.

After starting the tests and reaching a uniform distribution of the catalytic additive in the water volume of the boiler, pressure began to decline in the superheated steam line and consumption of natural gas increased, which indicated the decrease in evaporation caused by increased intermolecular forces in water. When steam produced in the changed conditions began to enter the running turbine, fast steam pressure growth started in the superheated steam line, and the automatics reduced the fuel supply to the boiler. Reduction in the flow rate of natural gas was 12% in the first test and 14% in the second test with respect to the previously recorded fuel flow rate. Each test lasted for five days, during which the achieved fuel flow rate was kept. During the tests the natural gas quality was laboratory controlled and stayed unchanged. After shutting off the catalytic substance supply the natural gas flow rate returned to the initial values within the day.

Tests of once-through boilers were carried out on P-57-2 boiler (CKD PP-1650-255 once-through boiler unit), designed to produce superheated, supercritical pressure steam with parameters P=24.5 MPa, t=545° C., and the steam boiler output of 1650 t/h. The steam boiler has a single vessel and T-shaped layout. The boiler is designed for burning brown coal. The boiler is equipped with sensors to provide control on all parameters of the boiler. The boiler has also valves for introducing a catalytic additive into the working fluid in the boiler.

Steam produced in the boiler entered K-500-240-2 steam turbine with rated power of 500 MW at the rotor speed of 3000 rev/min. Design parameters of fresh steam were $P_o$=23.5 MPa (240 kg/sq cm), $t_o$=540° C. Design absolute pressure in the turbine condenser at the design temperature of cooling water at the condenser inlet, +12° C., and the design flow rate, 51.480 t/h, was 0.0357 ATA. The turbine has nine unregulated steam extractions to heat feed water in low pressure heaters; in addition to regenerative extractions the turbine allows steam extraction to mains-operated heaters of I and II stage to cover the needs of district heating with the same power.

Effect of a catalytic additive introduced into the working fluid was observed on the variation in the speed of coal dust feeders at a constant boiler load (given amount of produced steam at the rated pressure). The catalytic additive was a mixture of dibutyl carbonate at concentration of 3 g/cu m, ammonium acetate at concentration of 1 g/cu m and acetamide at concentration of 3 g/cu m.

The ratio of substances in the catalytic mixture was chosen to promote its decomposition under the effect of high temperature and pressure.

After uniform introduction of the catalytic mixture of substances into the boiler feed water, fast pressure decline started in the superheated steam line, and the rotary speed of coal dust feeders increased, which indicated a decrease in evaporation caused by increased intermolecular forces in water. When steam produced in the changed conditions started entering the running turbine, a fast growth in the steam pressure in the superheated steam line began, and the automatics reduced the fuel supply to the boiler. Average reduction in the rotary speed of dust feeders was 12% of the previously recorded fuel flow rate. The test lasted seven days, during which achieved fuel flow rate was kept. During the test the coal quality was laboratory controlled and stayed unchanged. After shutting off the catalytic substance supply the rotary speed of the dust feeders returned to the initial values within a few hours.

The above examples are not exhaustive embodiments of the present invention and have been described to illustrate its industrial applicability.

The tests demonstrate the possibility of increasing the specific heat of vaporization and specific heat capacity of water, which enable increasing the enthalpy of steam and decreasing the amount of steam produced per time unit. This effect increases expansion of steam, so more mechanical work can be made for a fixed amount of thermal energy supplied, or the amount of thermal energy can be reduced to produce given amount of work. Therefore, the thermal efficiency of heat cycle of the steam turbine increases.

In addition, tests have shown that the process stabilization time of steam generators decreased by 10-15%.

A catalytic substance or a catalyst mixture of substances can be added to the working fluid in a wide range of ratios (from 0.0000001 to 0.1 wt. %) depending on the activity, decomposition grade and type of the steam generator.

Similarly to the most relevant prior art, a catalytic substance or a catalytic mixture of substances according to the invention enhances the actual enthalpy of vaporous working fluid, increases the compressibility factor and expansion, thereby enabling more mechanical work to be done; practically reduces the temperature in the boiler furnace, thereby decreasing the environment pollution; increases the specific heat of vaporization and specific heat capacity of the working fluid, while allowing optimization of the target process in practice in accordance with current needs and working conditions owing to newly discovered versatility of properties exhibited by the catalytic additive according to the inventive methods.

Furthermore, owing to the change in the spin state of water molecules, the introduced additive promotes crystallization of hardness salts within the bulk of the working fluid, rather than on heat transfer surfaces, which improves the heat transfer and increases the turnaround time.

Due to the change in the spin state of water molecules some of its physical and chemical characteristics also change, in particular: thermal conductivity, density, electrical conductivity, viscosity, solvent power, adsorption, activity of oxygen and other gases, speed of sound propagation, acidity, redox potential, and surface tension.

The effect, objectively manifested in practice of the present invention and confirmed, according to the description, by theoretical evidence and practical information, allows the long-standing need for affordable, safe, reliable means of converting thermal energy into mechanical energy and increasing the enthalpy and compressibility factor of steam to be satisfied in a wide range of applications.

The invention claimed is:

1. A method of converting thermal energy into mechanical energy, comprising:

imparting thermal energy, sufficient to transfer the working fluid from liquid to vapor phase, to the working fluid in a tank of a forced circulation steam generator;

feeding the working fluid in the vapor phase into a device for converting energy into mechanical work with expansion of the vaporous working fluid and reduction in temperature and pressure;

condensing the vaporous working fluid; and cyclically returning the working fluid in the liquid phase into the tank, wherein before or after said imparting of thermal energy to the working fluid a catalytic additive is introduced thereto, said catalytic additive being in the form of a solid, a solution or suspension thereof or a liquid or emulsion thereof, wherein a catalytic substance or a catalytic mixture of substances is used as the catalytic additive, said catalytic substance or at least one substance in the catalytic mixture comprises at least one carbonyl functional group and has at least one intense absorption band in the region from 1550 to 1850 $cm^{-1}$ in the IR spectrum, wherein the catalytic additive is introduced in an amount ranging from 0.0000001 to 0.1 wt. %, and wherein the catalytic substance or the weight ratio of individual substances in the catalytic mixture are chosen so as to promote decomposition of the catalytic substance or the catalytic mixture under the effect of high pressure and temperature.

2. A method according to claim 1, wherein said working fluid is water, or liquid hydrocarbon, or a mixture of liquid hydrocarbons.

3. A method according to claim 1, wherein said substance or substances for the additive is/are selected from the group including: monocarboxylic acids and anhydrides thereof; dicarboxylic acids and anhydrides thereof; salts of carboxylic acids; salts of dicarboxylic acids; amides of carboxylic acids; amides of dicarboxylic acids; anilides of carboxylic acids; anilides of dicarboxylic acids; esters of carboxylic acids; monoesters and diesters of dicarboxylic acids; imides of carboxylic acids; imides of dicarboxylic acids; diamide of carbonic acid; acyclic and cyclic esters of carbonic acid; urethanes; amino carboxylic acids, the molecules of which contain amino groups ($NH_2$ groups) and carboxyl groups (COOH groups); peptides and proteins, the molecules of which are made of remains of α-amino acids connected by peptide (amide) bonds C(O)NH.

4. A method for increasing the enthalpy and compressibility factor of steam, said method comprising heating water in a tank of a forced circulation steam generator to produce steam, wherein the method further comprises, before or after starting said heating, introducing a catalytic additive into the water, said catalytic additive being in the form of a solid, a solution or suspension thereof or a liquid or emulsion thereof, wherein a catalytic substance or a catalytic mixture of substances is used as the catalytic additive, said catalytic substance or at least one substance in the catalytic mixture comprising at least one carbonyl functional group and has at least one intense absorption band in the region from 1550 to 1850 $cm^{-1}$ in the IR spectrum, wherein the catalytic additive is introduced in an amount ranging from 0.0000001 to 0.1 wt. %, and wherein the catalytic substance or the weight ratio of individual substances in the catalytic mixture are chosen so as to promote decomposition of the catalytic substance or the catalytic mixture under the effect of high pressure and temperature.

5. A method according to claim 4, wherein said substance or substances for the additive is/are selected from the group including: monocarboxylic acids and anhydrides thereof; dicarboxylic acids and anhydrides thereof; salts of carboxylic acids; salts of dicarboxylic acids; amides of carboxylic acids; amides of dicarboxylic acids; anilides of carboxylic acids; anilides of dicarboxylic acids; esters of carboxylic acids; monoesters and diesters of dicarboxylic acids; imides of carboxylic acids; imides of dicarboxylic acids; diamide of carbonic acid; acyclic and cyclic esters of carbonic acid; urethanes; amino carboxylic acids, the molecules of which contain amino groups ($NH_2$ groups) and carboxyl groups (COOH groups); peptides and proteins, the molecules of which are made of remains of α-amino acids connected by peptide (amide) bonds C(O)NH.

* * * * *